United States Patent [19]

Matsumura et al.

[11] 4,009,991

[45] Mar. 1, 1977

[54] PROCESS FOR PRODUCING CARBON FIBERS

[75] Inventors: Yasuo Matsumura; Soichiro Kishimoto; Masahiko Ozaki, all of Okayama, Japan

[73] Assignee: Japan Exlan Company Limited, Osaka, Japan

[22] Filed: Sept. 17, 1975

[21] Appl. No.: 614,153

[30] Foreign Application Priority Data

Sept. 20, 1974 Japan ..... 49-109163

[52] U.S. Cl. ..... 432/23; 432/59

[51] Int. Cl.[2] ..... F27B 9/04

[58] Field of Search ..... 432/8, 59, 18, 23

[56] References Cited

UNITED STATES PATENTS

| | | | |
|---|---|---|---|
| 2,665,125 | 1/1954 | Klug | 432/8 |
| 3,547,420 | 12/1970 | Longstuff | 432/8 |

*Primary Examiner*—John J. Camby

*Attorney, Agent, or Firm*—Wenderoth, Lind, & Ponack

[57] ABSTRACT

Carbon fibers are produced by continuously heat-treating acrylonitrile fibers up to the crystal collapse starting temperature of said fibers while maintaining said fibers under a fixed length or tension in an oxidizing atmosphere, then sufficiently thermally stabilizing fibers by further subsequently continuously heat-treating them in a temperature range gradually elevated up to a fixed temperature in a range of from a temperature about 20° C lower than the deterioration starting temperature of said fibers to a temperature about 20° C higher than said deterioration starting temperature in an oxidizing atmosphere. The thus sufficiently thermally stabilized fibers are treated with a reducing liquid and subsequently carbonized or graphitized in a non-oxidizing atmosphere or under a vacuum.

11 Claims, 3 Drawing Figures

PROCESS FOR PRODUCING CARBON FIBERS

Figure 1:
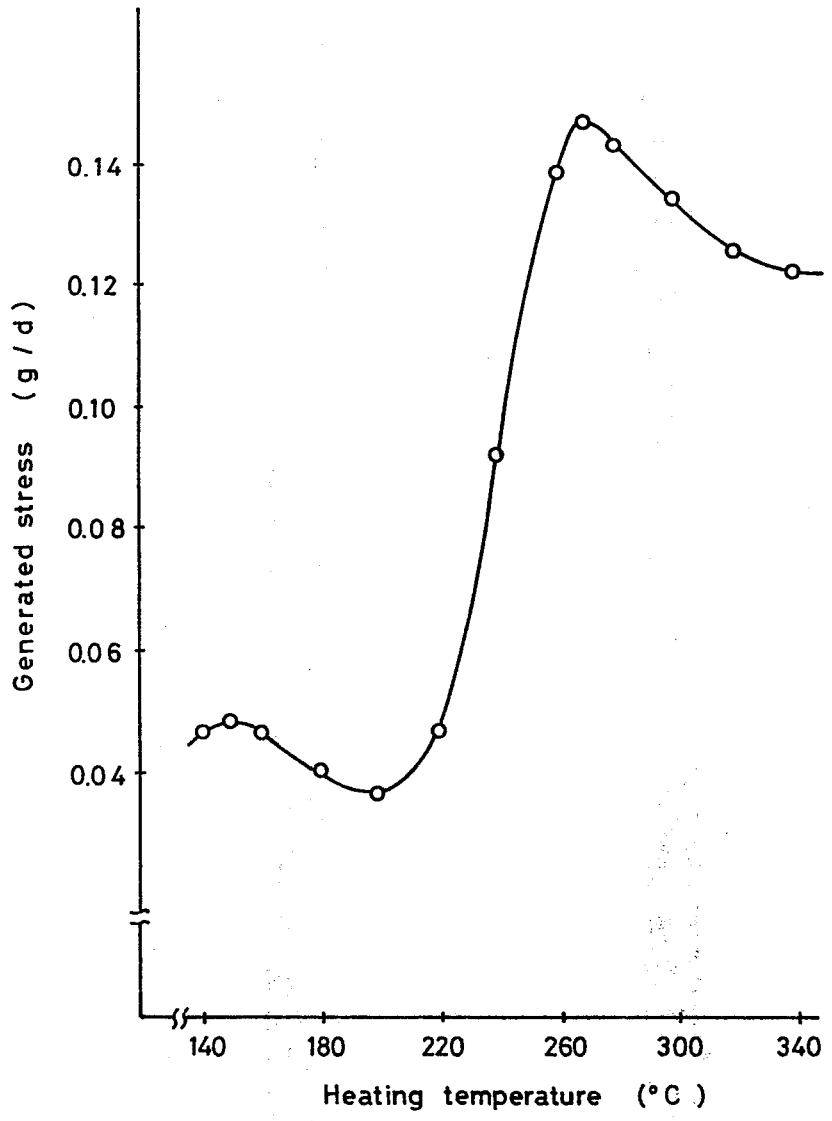

This invention relates to a process for producing carbon fibers (including graphite fibers) from acrylonitrile fibers. More particularly this invention relates to a process for producing carbon fibers from acrylonitrile fibers by continuously heating the acrylonitrile fibers in a gradually elevated temperature range for the thermal stabilization, which comprises conducting the heating for the stabilization by setting the maximum temperature in said temperature range so as to be near the temperature at which the deterioration of the fibers starts, so that the thermal stabilization is effected to a sufficient or somewhat excessive extent, and then treating the stabilized fibers with a reducing liquid and then subjecting the same to the conventional carbonization or graphitization, to obtain carbon fibers having excellent properties particularly high strength and high elasticity.

It is known that carbon fibers useful as reinforcing materials, exothermic bodies and heat-resistant materials are obtained by cyclizing (ring formation) ANF by heating them at about 150° to 400° C. in an oxidizing atmosphere and then firing or baking them at a higher temperature (usually above 800° C.) in a non-oxidizing atmosphere.

The step of forming cyclized structure of naphthylidine rings in ANF by first heat-treating them in an oxidizing atmosphere or the so-called thermally stabilizing step is a very important step influencing the physical properties of the final product carbon fibers. A heat-treating operation for a long time has been required for such step and has been a cause of the low productivity of carbon fibers.

That is to say, in order to produce carbon fibers of a high strength and high elasticity, it is necessary in such thermally stabilizing step not only to heat the fibers while applying a tension to them but also to inhibit a quick exothermic reaction from being caused by heating. Therefore, it has been conventional that the stabilizing treatment is carried out at a temperature considerably lower than the heat generation starting temperature starting from the crystal collapsing temperature of ANF. Therefore, the cyclizing and cross-linking reaction and dehydrogenating reaction of the nitrile groups in ANF by the oxidization can not be sufficiently effected. In order to sufficiently carry out these reactions, a heat-treatment for a long time is required.

On the other hand, in case a high temperature stabilizing condition or a quick temperature elevating operation is adopted to increase the productivity of carbon fibers, violent reactions such as intermolecular cross-linking and intramolecular cyclization will occur at a temperature near the exothermic transition point of the fibers, and therefore a local heat accumulation will occur causing such non-uniform reaction as of producing a pitch-tarry substance with a result that carbon fibers are fused together or their mechanical strength is lowered. Particularly, in either of such already suggested stabilizing methods as a thermostatic treating method wherein fibers are kept for a long time at a fixed temperature at which the fibers can be stabilized and a temperature elevating treating method wherein fibers are continuously heat-treated in a continuously or steppedly elevated temperature range, when the stabilizing treatment is applied in a high temperature range above the crystal collapse starting temperature of ANF, oxygen will be bonded or adsorbed in excess in the thermally stabilized fibers and has had a very bad influence on the strength and modulus of elasticity of the final carbon fibers.

We have now found that carbon fibers having a high elasticity and high strength can be produced within a very short time in a thermally stabilizing method adopting the above described temperature elevating treating method when ANF are heat treated, while applying a tension (including a fixed length) to them, up to at least the crystal collapse starting temperature of ANF, and further heated continuously or steppedly to a deterioration starting temperature which is in a high temperature range generally above said crystal collapse starting temperature, and then the obtained stabilized fibers are treated with a reducing liquid to eliminate or reduce oxygen present in excess in said fibers, and then subjected to the carbonization or graphitization in an ordinary manner.

Thus the principal object of the present invention is to provide a process for producing carbon fibers from ANF with much higher productivity than any conventional process.

Another object of the present invention is to produce carbon fibers excellent in the physical properties, particularly high strength and high elasticity within a short time.

Another object of the present invention is to provide a stabilizing method for thermally stabilizing ANF advantageously by giving them a reasonable heat hysteresis, said method being applicable to any ANF, and also to industrially advantageously produce carbon fibers excellent in the physical properties by combining the deoxygenating treatment by a reducing liquid with the above mentioned thermally stabilizing method.

Figure 2:
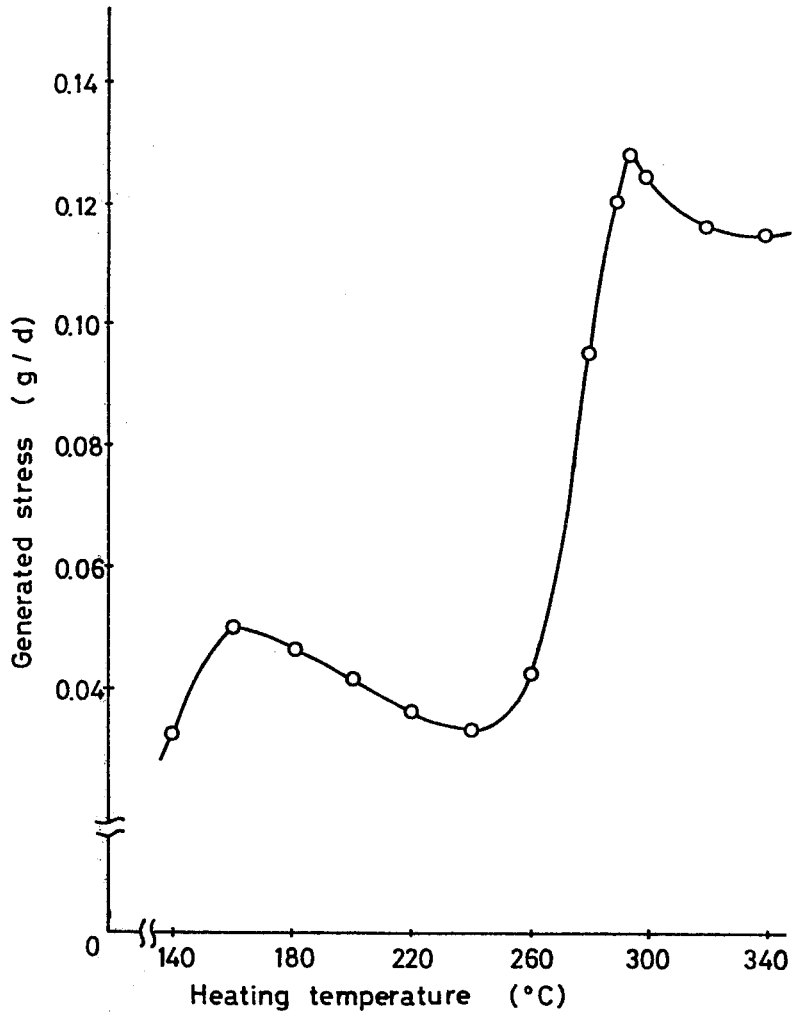

Further objects of the present invention will become clear from the following description which will be made by referring partly to the accompanying drawings wherein FIGS. 1 and 2 are graphs showing stresses generated in ANF at various temperatures.

Figure 3:
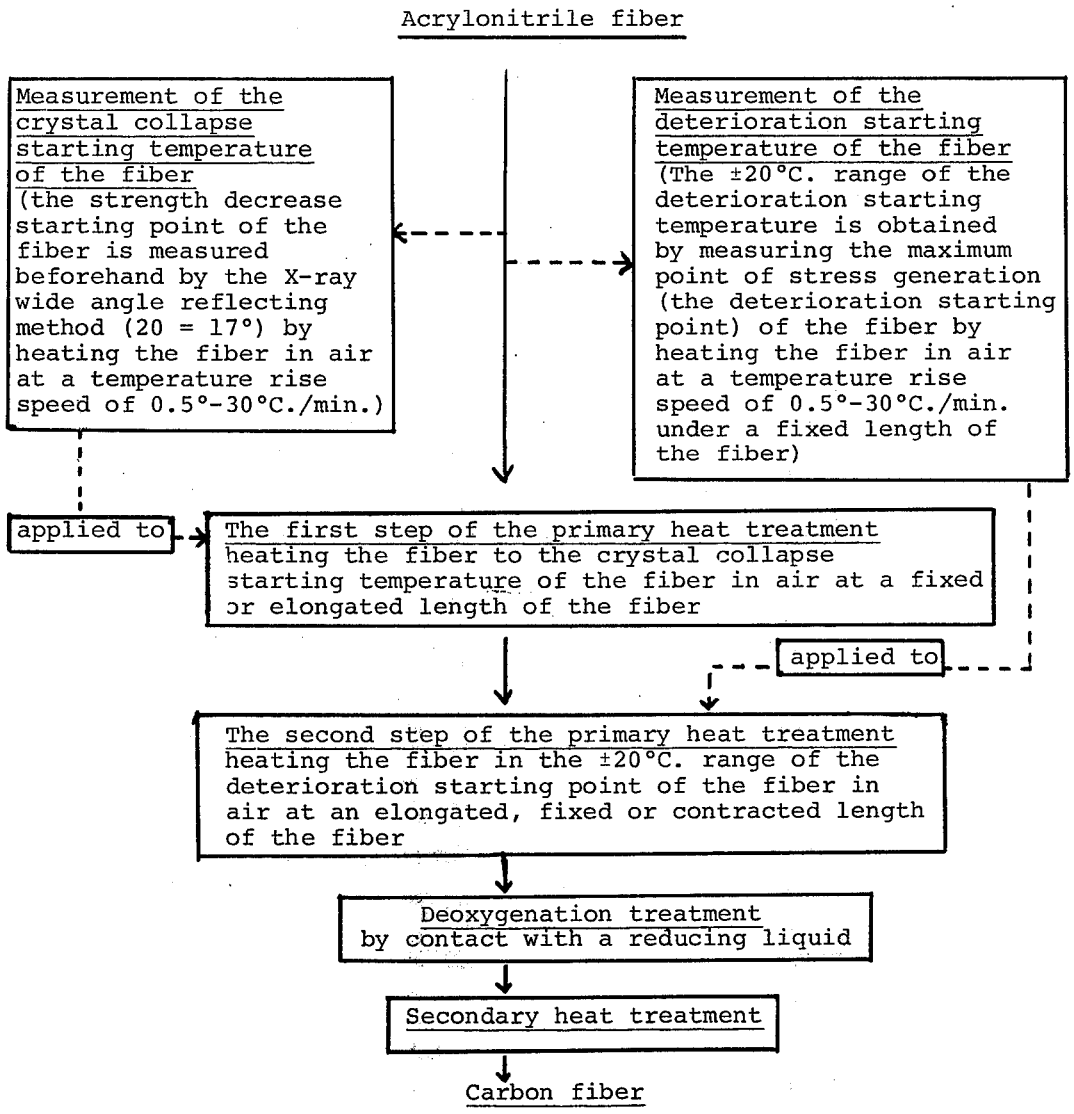

FIG. 3 is a flow sheet illustrating the production of the carbon fibers of the present invention.

These objects can be attained by this invention wherein ANF (acrylonitrile fibers) are continuously heat treated up to the crystal collapse starting temperature of said fibers while keeping the fiber length constant or applying a tension in an oxidizing atmosphere, then the fibers are sufficiently stabilized by continuously heat-treating them in a temperature range gradually elevated to a predetermined temperature which is in a range from a temperature about 20° C. lower than the deterioration starting temperature of said fibers to a temperature about 20° C. higher than said deterioration starting temperature, then the thus obtained stabilized fibers are treated with a reducing liquid and then subjected to the carbonization or graphitization in a non-oxidizing atmosphere or under a vacuum.

According to such process of the present invention, application of tension over the entire range of said heat-treatment as has hitherto been considered necessary for the ANF thermally stabilizing treatment is not always necessary, the tension or fixed length operation carried out in the initial stage (the heat-treating step up to the crystal collapse starting temperature) in the thermally stabilizing step is sufficient. The treated fibers can be allowed to contract or shrink in the later period (the heat-treating step from the crystal collapse starting temperature to the vicinity of the deterioration starting temperature) of the subsequent thermally stabilizing step. It is even possible to heat-treat them while contracting them throughout the entire range of the thermally stabilizing step. Thus such troubles as napping and breaking of fibers occurring so far mostly in the later period of the thermally stabilizing step can be overcome.

Further, according to the process of the present invention, such imperfect thermal stabilization and remarkable excess thermally stabilizing treatment as in the conventional process in the ANF stabilizing treatment are avoided, the intramolecular cyclization of the nitrile groups, dehydrogenating reaction or cross-linking reaction by the oxidization can be made to properly proceed into the center part of the fiber, the remarkable deteriorating reaction of the fibers can be prevented. Therefore there can be obtained thermally stabilized fibers having a non-defective structure suitable for the subsequent carbonization. Further the thermal stabilization can be effected within a very short time. Therefore, by using the thus obtained thermally stabilized fibers, carbon fibers having very excellent physical properties can be industrially advantageously produced.

Here ANF so called in the present invention are fibers produced from a polyacrylonitrile or an acrylonitrile copolymer containing at least 80 mol percent, preferably more than 90 mol percent acrylonitrile. For the comonomer components, there can be enumerated such well known ethylenically unsaturated compounds as allyl alcohol, methallyl alcohol, $\beta$-hydroxypropyl acrylonitrile, acrylic acid, methacrylic acid, itaconic acid, crotonic acid, methacrylonitrile, $\alpha$-methylene glutaronitrile, isopropenyl acetate, acrylamide, N-methylol acrylamide, $\beta$-hydroxyethyl methacrylate, dimethyl aminoethyl methacrylate, vinyl pyridine, vinyl pyrrolidone, methyl acrylate, methyl methacrylate, vinyl acetate, acryl chloride, sodium methallylsulfonate and potassium p-styrenesulfonate.

The thermally stabilizing treatment of such ANF is carried out by heating them usually in a temperature range from 150° to 400° C. in an oxidizing atmosphere. However, the heating system in the stabilizing step according to the present invention is not a method wherein the fibers are heated for a long time at a fixed temperature but a method wherein they are heated in a continuously or steppedly elevated temperature range and there is an advantage that the thermally stabilizing treatment time can be reduced to one-fifth to one-tenth that in the former. As a practical operation for conducting the thermally stabilizing treatment of this invention, there is adopted a method wherein ANF are continuously passed in the lengthwise direction through a heating furnace having a temperature gradient or a batch method wherein ANF are wound on a bobbin or the like and are put into a heating furnace and the temperature of the atmosphere in the furnace is elevated. The temperature elevating velocity to be adopted is generally 0.5° to 30° C./min., preferably 1° to 20° C./min. or more preferably 2° to 12° C./min.

Usually, when ANF are heated gradually to a higher temperature under a temperature elevating condition of 0.5° to 30° C./min. in an oxidizing atmosphere such as air or an oxygen-containing gas, the modification of the nitrile (—C ≡ N) groups in the ANF will begin to occur between about 190° and 260° C. and will end between about 280° and 320° C. Such behavior is definitely confirmed by the variation of the absorption strength ratio of the IR spectra based on the elongating and contracting oscillations of the nitrile group appearing at 2250 cm.$^{-1}$. Further, such modification of the nitrile group is considered to proceed first preferentially in the non-crystal range of the fibers and the collapse of the polyacrylonitrile crystals in the fibers is not substantially recognized in the initial period of the modification of the nitrile group. Further, with the beginning of the modification of the nitrile group, the fiber structure will be relaxed (loosened) and therefore the contracting stress and breaking elongation of the fibers will increase. Such relaxation of the fiber structure will further last until a higher temperature and, when the crystal collapse starting temperature of the polyacrylonitrile is reached, the relaxing phenomenon will vanish.

When such fiber structure relaxing phenomenon is caused, the arrangement and orientation of the polyacrylonitrile molecular chains in the fibers will be likely to be disordered and therefore, in the temperature range in which such relaxation is caused, it is necessary to impart a proper tension to the fibers to prevent the disorder of the above mentioned molecular arrangement and orientation. In this temperature range, the breaking strength is so small that a too large tension will break the fibers or will cause a structural defect. On the other hand, a too small tension will not be effective to inhibit the disturbance or disordering of the molecular arrangement and orientation. Therefore, the tension to be used in this temperature range is 0.05 to 1.0 g./d., preferably 0.1 to 0.8 g./d. and more preferably 0.2 to 0.6 g./d. Under these tension conditions, the fiber length variation will have no dimensional variation (will have a fixed length) from the original length or will correspond to an elongation up to about 50 percent on the original length. Such dimensional variation will be remarkably influenced by the stretching conditions and drying conditions at the time of producing ANF. Anyhow, it is necessary to heat-treat them under a fixed length or under a tension until the crystal collapse starting temperature is reached.

Further, in the temperature range before the fiber structure relaxing phenomenon occurs, the tension may be applied in a range of 0.1 to 1.0 g./d. and the fibers may be heat-treated under a fixed length so that no dimensional variation may be caused.

Further, in any case of such temperature ranges, the tension may be well varied as divided into some stages in response to the temperature variation, within the respective ranges of tension mentioned before.

The crystal collapse starting temperature of ANF or, in other words, the collapse starting temperature of polyacrylonitrile crystals in ANF is different depending on the particular comonomer of the polymer forming the fibers and the heating temperature elevating velocity. However, generally, under the heating temperature elevating condition of 0.5° to 30° C./min., it is in a range of about 230° to 290° C. and can be presumed from the temperature at which said strength begins to reduce by measuring the diffractive strength of $2\theta = 17°$ by the X-ray wide angle reflecting method. Such crystal collapse starting temperature can be considered to be identical with the temperature at which the crystal orientation degree and crystal width of the fibers begin to reduce.

Another important feature of the present invention is to well thermally stabilize such fibers by continuously heat-treating them while gradually elevating the temperature up to the vicinity of the deterioration starting temperature existing in a high temperature range higher than the above mentioned crystal collapse starting temperature in an oxidizing atmosphere, subsequently to such continuous heat-treatment up to the crystal collapse starting temperature of the fibers. The maximum temperature in said thermal stabilization step should be maintained below a temperature which is about 20° C. higher than the deterioration starting temperature. That is to say, even if ANF are continuously heat-treated up to the crystal collapse starting temperature at a practical temperature elevating velocity, the fibers will not be able to be sufficiently thermally stabilized to the center part of the fiber. On the other hand, in case the heat-treatment is continued to a too high temperature exceeding the deterioration starting temperature, the thermal stabilization will proceed in excess and the deterioration of the fibers will become so remarkable that it will be difficult to obtain carbon fibers of high physical properties. Therefore, in order to well thermally stabilize ANF, it is necessary to further continuously heat-treat them up to a temperature in a range from a temperature about 20° C., preferably about 10° C. lower than the deterioration starting temperature of the fibers to a temperature about 20° C. higher than said deterioration starting temperature. In the case of such heat-treatment, the same heating operation, temperature elevating method and condition and tension condition as in the above mentioned heat-treating conditions up to the crystal collapse starting temperature can be adopted but particularly such tension condition as contracting ANF in addition to maintaining them under a fixed length or under a tension may well be adopted.

The deterioration starting temperature of ANF fluctuates with the kind, molecular weight, spinning condition and temperature elevating heating condition of the fiber-forming polymer. However, generally, when ANF are fixed at both ends and are continuously heat-treated in air under the temperature elevating rate of 0.5° to 30° C./min., the maximum value of the generated stress will be observed in the range of about 260° to 320° C. and the temperature showing such maximum stress will generally coincide with the deterioration starting temperature, because, from the fact that, if the heating is continued in excess of the temperature showing such maximum stress is defined to be a deterioration starting temperature of said fibers.

In the thermally stabilized fibers obtained through such stabilizing step, the thermal stabilization has proceeded to the center part of the fiber but excess oxygen is bonded or adsorbed within the fiber. In case such fibers are subjected as such to a carbonizing or graphitizing step, an adverse influence will be brought to the quality of the final carbon fibers. Therefore, in the present invention, it is an essential requirement to apply a deoxygenating treatment to such thermally stabilized fibers. The deoxygenating treatment for eliminating or reducing oxygen present in excess in the thermally stabilized fiber can be carried out by treating the thermally stabilized fibers with a reducing liquid.

The reducing liquid to be used here is a liquid containing at least one kind of well known reducing compounds having a strong oxygen inactivating ability such as oxyacids and their salts, e.g. thiosulfuric acid, polythionic acid, dithionic acid, sulfurous acid, pyrosulfurous acid and their salts, salts of dithionous acid and sodium formaldehyde sulfoxylate ($CH_2 \cdot OH \cdot SO_2Na$); sulfinic acids and their salts and acid halides of sulfenic acids; aromatic compounds having two or more hydroxyl groups connected to the same benzene ring such as catechol, hydroquinone, resorcinol, pyrogallol, fluoroglucinum, naphthohydroquinone and anthrahydroquinone. Further, quinone converted to be substantially of a reducing type such as quinhydron which is a molecular compound of hydroquinone and quinone or a mixed aqueous solution of a salt of dithionous acid (dithionite) and $\beta$-anthraquinone sulfonate is also useful.

In the treatment by using such reducing liquid, the effect of the reducing compound can be made enhanced by keeping the pH of the treating liquid above 10. The concentration of the reducing compound in the treating liquid can be varied depending upon the kind, the treating temperature and time and the pH of the treating liquid. However, generally, the concentration is 1 to 50 percent by weight, preferably 5 to 35 percent by weight. Further, such reducing compound is used usually as dissolved in water to form a reducing liquid according to the present invention but may be used also as dissolved in an organic solvent such as alcohol, acetone or trichloroethylene. In case the reducing compound deposited on the fibers thermally stabilized by the treatment according to the present invention is an inorganic salt or alkali metal compound, it will be desirable to wash the fibers before the carbonizing step to remove the reducing agent from the thermally stabilized fibers. In addition, the effect of the reducing liquid will appear in a very short time and the object will be attained substantially within several minutes but, due to the restriction in the apparatus, in fact, the fibers are treated within 1 to 60 minutes. The temperature of the reducing liquid is in a range below 100° C. or of preferably 0° to 50° C. or more preferably 5° to 40° C.

The thermally stabilized fibers thus treated with the reducing liquid is introduced into a heating furnace filled with a non-oxidizing atmosphere or under a vacuum preferably without being exposed to an oxygen-containing atmosphere and is carbonized or graphitized at a temperature above 800° C. in an ordinary manner to produce objective carbon fibers having excellent performances.

By adopting such step according to the present invention, it is possible to produce carbon fibers excellent in the strength and modulus of elasticity within a short time.

A temperature in a range of 800° to 2000° C. is generally adopted for the carbonizing temperature. Further, a temperature of 2000° to 3500° C. is generally adopted to further graphitize the carbon fibers. Further, nitrogen, helium or argon is preferable for the non-oxidizing atmosphere to be used in the carbonizing or graphitizing step. It is effective to improve the physical properties, particularly the Young's modulus of carbon fibers by heating them under tension during such step.

In order to have the present invention better understood, typical examples of the present invention will be shown in the following. In these examples, the percentages and parts are by weight unless otherwise specified.

Reference Example

Acrylonitrile long fibers A produced from a copolymer consisting of 98 mol percent acrylonitrile and 2 mol percent methacrylic acid and acrylonitrile long fibers B produced from a copolymer consisting of 97 mol percent acrylonitrile and 3 mol percent methyl acrylate were respectively continuously heat-treated at a temperature elevating rate of 3° C./min. from 140° to 300° C. in an air atmosphere and the infrared absorption spectra and X-ray diffraction strengths of the respective fibers at various temperatures were measured. That is to say, from the variation of the absorption strength of the infrared absorption spectrum based on the elongating and contracting oscillations of the nitrile group appearing at 2250° cm.$^{-1}$, the degrees of the variation of the nitrile group in the fibers were presumed and are shown in Table 1. Further, by making the X-ray diffraction strength of $2\theta = 17°$ at the normal temperature 100°, the X-ray diffraction strength ratios of $2\theta = 17°$ at various temperatures were determined and the results are shown in Table 2.

As evident from the results in Table 1, it is understood that the nitrile group in the fibers began to be modified at about 200° C. in the case of the fibers A and at about 240° C. in the case of the fibers B. Further, from the results in Table 2, it is evident that the crystal collapse starting temperature of the fibers was about 240° C. in the case of the fibers A and about 280° C. in the case of the fibers B.

Table 1:

| | Nitrile group variation rate (%) Treating temperature (° C.) | | | | | | | |
|---|---|---|---|---|---|---|---|---|
| Fibers | 140 | 180 | 200 | 220 | 240 | 260 | 270 | 300 |
| A | 0 | 0 | 4 | 15 | 38 | 62 | 85 | 96 |
| B | 0 | 0 | 0 | 0 | 7 | 53 | 60 | 93 |

Table 2:

| | X-ray diffraction strength ratio Treating temperature (° C.) | | | | | | | |
|---|---|---|---|---|---|---|---|---|
| Fibers | 140 | 180 | 200 | 220 | 240 | 260 | 280 | 300 |
| A | 100 | 100 | 100 | 100 | 99 | 95 | 86 | 77 |
| B | 100 | 100 | 100 | 100 | 100 | 100 | 98 | 79 |

Further, the above mentioned two kinds of fibers were heat-treated at elevated temperatures under the same conditions as were mentioned above while being maintained under a fixed length and the stresses (g./d.) generated at various temperatures were measured. The results are shown in FIG. 1 (for the fibers A) and FIG. 2 (for the fibers B).

From FIG. 1, the deterioration starting temperature of the fibers A was determined to be about 270° C. and, from FIG. 2, the deterioration starting temperature of the fibers B was determined to be about 295° C.

EXAMPLE 1

The fibers A used in the reference example were continuously heat-treated under a tension of a stretching rate of −5 percent (contraction), 0 percent (fixed length) or 5 percent (elongation) at a temperature elevating rate of 3° C./min. from 180° to 240° C. in an air atmosphere and were then further continuously heated in an air atmosphere at a temperature elevating rate of 3° C./min. under a tension of a stretching rate of −2 percent in a temperature range from 240° to 280° C. (about 10° C. higher than the deterioration starting temperature).

The thus obtained thermally stabilized fibers were treated with a reducing liquid consisting of an aqueous solution of a pH of 8 containing 5 percent $Na_2S_2O_4$, were then washed with water, were dried in a nitrogen atmosphere and were then continuously heat-treated in a nitrogen atmosphere at a temperature elevating rate of 90° C./min. from 250° to 1200° C. to obtain carbon fibers.

The physical properties of the thus obtained various carbon fibers were measured and the results are shown in Table 3. As evident from the results in Table 3, in order to improve the physical properties of carbon fibers, a fixed length or stretching operation is necessary for the fibers in the heat-treatment up to the crystal collapse starting temperature.

By the way, in the experiment No. 2 in which no reducing liquid treatment was applied, the physical properties of the obtained carbon fibers were very low. From such fact, it is evident that, in order to obtain carbon fibers of high physical properties, it is necessary to treat thermally stabilized fibers with a reducing liquid.

Table 3

| | Stretching rate (%) until the | | Physical properties of carbon fibers | |
|---|---|---|---|---|
| No. | crystal collapse starting temperature | Reducing liquid treatment | Young's modulus (tons/mm²) | Strength (kg/mm²) |
| 1 | −5 | Present | 20 | 2.35 |
| 2 | 0 | Absent | 19 | 2.20 |
| 3 | 0 | Present | 23 | 3.19 |
| 4 | 5 | Present | 24 | 3.17 |

On the other hand, instead of the above mentioned stabilizing treating method by heat-treating them while elevating the temperature, a stabilizing treatment at a fixed temperature was applied in an air atmosphere under the conditions shown in Table 4 and then the above mentioned carbonizing conditions were adopted to produce various carbon fibers.

As evident from the results in Table 4, in the method wherein ANF were stabilized in an atmosphere maintained at a fixed temperature, a very long time was required for the stabilizing treatment and the physical properties of the product fibers were not comparable with those of the carbon fibers obtained according to the process of the present invention.

Table 4

| No. | Stabilizing treatment conditions: Temp. (° C.) | Time (hours) | Stretching rate (%) | Physical properties of carbon fibers: Young's modulus (tons/mm²) | Strength (kg/mm²) |
|---|---|---|---|---|---|
| 5 | 220 | 9 | 0 | 22 | 2.97 |
| 6 | 220 | 9 | 5.3 | 23 | 3.03 |
| 7 | 230 | 4 | 0 | 21 | 2.81 |
| 8 | 240 | 3 | 0 | 20 | 2.36 |

EXAMPLE 2

The fibers B (crystal collapse starting temperature of about 280° C. and deterioration starting temperature of about 295° C.) used in the reference example were continuously heated and stabilized at the temperatures and under the tension conditions shown in Table 5 at a temperature elevating rate of 2° C./min. in an air atmosphere by using a heating furnace having a temperature gradient, were then passed through a reducing aqueous solution of a pH of 8 containing 5 percent $Na_2S_2O_4$, were dried under a reduced pressure, were then introduced into a heating furnace and had the temperature gradually elevated by requiring 33 minutes from 250° to 1250° C. in a vacuum of $2 \times 10^{-3}$ mm.Hg to apply a carbonizing operation. By the way, the stretching rate of the fibers in the carbonizing step was −5 percent. The physical properties of the obtained carbon fibers were measured and are shown in Table 5.

As evident from the results in Table 5, whereas the carbon fibers obtained in the experiment No. 9 according to the process of the present invention showed high physical properties, carbon fibers of high physical properties could not be obtained in any of the experiment No. 10 in which no sufficient tension condition was imparted until the crystal collapse starting temperature, experiment No. 11 in which no heat-treatment was applied until the deterioration starting temperature and experiment No. 12 in which a stabilizing treatment was carried out until a higher temperature exceeding the deterioration starting temperature.

Table 5

| No. | Stabilizing treatment temperature (° C.): Under a fixed length | Under a contraction | Physical properties of carbon fibers: Young's modulus (tons/mm²) | Strength (kg/mm²) |
|---|---|---|---|---|
| 9 | 200 → 280 | 280 → 310 | 24 | 3.21 |
| 10 | 200 → 240 | 240 → 310 | 17 | 1.65 |
| 11 | 200 → 280 | — | Broken during the carbonizing treatment | |
| 12 | 200 → 280 | 280 → 320 | 22 | .93 |

*Stretching rate: −2 %

EXAMPLE 3

ANF produced from a copolymer of the same composition as of the fibers A used in the reference example were continuously heat-treated under a load of 0.36 g./d. (stretching rate of 27.5 percent) at a temperature elevating rate of 5° C./min. from 170° to 240° C. which was the crystal collapse starting temperature of said fibers in an air atmosphere by using a heating furnace having a temperature gradient and were then further heat-treated at a stretching rate of +4.3 percent at a temperature elevating rate of 3° C./min. in an air atmosphere from 240° C. to 280° C. (about 10° C. higher than the deterioration starting temperature) in the same manner to obtain stabilized fibers. Then, such stabilized fibers were subjected to the same reducing liquid treatment as in Example 2 and had the temperature gradually elevated by taking 8 minutes from 280° to 1100° C. to be carbonized.

The thus obtained carbon fibers showed very excellent physical properties of a Young's modulus of 24 tons/mm² and strength of 3.54 kg./mm².

What is claimed is:

1. A process for producing carbon fibers which comprises continuously heat-treating acrylonitrile fibers up to the crystal collapse starting temperature of said fibers while maintaining said fibers under a fixed length or tension in an oxidizing atmosphere, then sufficiently thermally stabilizing said fibers by further subsequently continuously heat-treating them in a temperature range gradually elevated up to a fixed temperature in a range from a temperature about 20° C. lower than the deterioration starting temperature of said fibers to a temperature about 20° C. higher than said deterioration starting temperature in an oxidizing atmosphere, treating the thus obtained thermally stabilized fibers with a reducing liquid and subsequently carbonizing or graphitizing said fibers in a non-oxidizing atmosphere or under a vacuum.

2. The process for producing carbon fibers as claimed in claim 1 wherein acrylonitrile fibers are thermally stabilized by being continuously passed through a heating furnace having a positive temperature gradient.

3. The process for producing carbon fibers as claimed in claim 1 wherein acrylonitrile fibers are thermally stabilized by being heated by elevating the temperature at a rate of 0.5° to 30° C./min.

4. The process for producing carbon fibers as claimed in claim 3 wherein the temperature elevating rate is 1° to 20° C./min.

5. The process for producing carbon fibers as claimed in claim 1 wherein acrylonitrile fibers are sufficiently thermally stabilized by being heated by gradually elevating the temperature up to a fixed temperature in a range from a temperature about 10° C. lower than the deterioration starting temperature of said fibers to a temperature about 20° C. higher than said deterioration starting temperature.

6. The process for producing carbon fibers as claimed in claim 1 wherein acrylonitrile fibers are thermally stabilized while a tension of 0.05 to 1.0 g./d. is being imparted to them.

7. The process for producing carbon fibers as claimed in claim 1 wherein said oxidizing atmosphere is air.

8. The process for producing carbon fibers as claimed in claim 1 wherein said acrylonitrile fiber is a fiber made from an acrylonitrile homopolymer or an acrylonitrile copolymer containing at least 80 mol percent acrylonitrile and an ethylenically unsaturated compound.

9. The process for producing carbon fibers as claimed in claim 1 wherein said reducing liquid contains at least one reducing compound selected from the group consisting of oxyacids of sulfur and their salts, sulfinic acids and their salts, acid halides of sulfenic acids and aromatic compounds having two or more hydroxyl groups connected to the same benzene ring.

10. The process for producing carbon fibers as claimed in claim 1 wherein said non-oxidizing atmosphere is nitrogen.

11. The process for producing carbon fibers as claimed in claim 1 wherein said thermally stabilized fibers are carbonized at a temperature of from 800° to 2000° C. and are then graphitized at a temperature of from 2000° to 3500° C.

* * * * *